US005180143A

United States Patent [19]

Brower

[11] Patent Number: 5,180,143

[45] Date of Patent: Jan. 19, 1993

[54] PORTABLE SPORT BOUNDARY FENCE

[75] Inventor: William S. Brower, Southern Pines, N.C.

[73] Assignee: Belvedere Sports, Tiburon, Calif.

[21] Appl. No.: 646,675

[22] Filed: Jan. 28, 1991

[51] Int. Cl.[5] ..... F04H 17/16

[52] U.S. Cl. ..... 256/24; 256/19; 273/411

[58] Field of Search ..... 256/25, 24, 12.5, 29, 256/30, 31, 35, 36, 19, 73, DIG. 2; 273/411, 29 BB; 403/2

[56] References Cited

U.S. PATENT DOCUMENTS

| | | | |
|---|---|---|---|
| 3,347,527 | 10/1967 | Andrews | 256/24 X |
| 4,576,364 | 3/1986 | O'Fearna | 256/24 |
| 4,605,204 | 8/1986 | Schmanski | 256/19 |
| 5,029,819 | 7/1991 | Kane | 256/24 |

FOREIGN PATENT DOCUMENTS

| | | | |
|---|---|---|---|
| 2919582 | 11/1980 | Fed. Rep. of Germany | 256/12.5 |
| 2522051 | 8/1983 | France | 256/12.5 |
| 580710 | 10/1976 | Switzerland | 256/12.5 |

*Primary Examiner*—Peter M. Cuomo
*Attorney, Agent, or Firm*—Jon L. Roberts

[57] ABSTRACT

A portable sport boundary fence is provided for use in a miniaturized baseball game wherein a hollow, perforated plastic ball is used with a hollow plastic bat wherein the fence comprises a plurality of hollow, tubular posts, each of which is slidably and removably engaged by a post anchor, wherein each of the posts is sufficiently thin at its base so that, when impacted by a player, the post either bends or breaks to avoid injury to the player, and wherein perforated netting is provided to extend between the posts and connectors are used to attach the perforated netting to each of the posts.

5 Claims, 1 Drawing Sheet

PORTABLE SPORT BOUNDARY FENCE

BACKGROUND AND SUMMARY OF THE INVENTION

The present invention relates in general to a lightweight and portable sport boundary fence. More particularly, the invention relates to a portable outfield boundary fence for a miniaturized baseball game wherein a perforated, hollow plastic ball is used with a lightweight plastic bat. The outfield boundary fence can be conveniently and readily set up on a relatively small portion of a park, playground or other public area and can be readily disassembled and conveniently stored for future use.

The prior art includes rather cumbersome wire enclosures for playing or practicing baseball such as the Long U.S. Pat. No. 4,798,389 and Bingham U.S. Pat. No. 2,823,034, which are heavy, non-portable enclosures. The prior art also includes heavy and cumbersome sport net supports such as Halverson U.S. Pat. No. 4,732,395 and Leonard U.S. Pat. No. 4,284,277, which use weighted anchors to support posts for a sport net. The prior art also includes relatively permanent out-of-bounds markers which are embedded in trenches as shown in Brandli U.S. Pat. No. 4,832,331.

The present invention provides a lightweight and portable outfield boundary fence which utilizes a novel combination of individually old components to provide an outfield boundary fence. The portable fence of the present invention is used in conjunction with a hollow perforated ball and a lightweight plastic bat to reduce or miniaturize the size of the field needed to play a challenging and exciting, if not full sized, game of baseball. With the ever increasing demand on public playgrounds and parks, the present invention enables youngsters and adults alike to readily set up a small scale baseball field on a small portion of what is ordinarily required for a regulation size baseball or softball field.

Accordingly, a primary object of the invention is to provide a lightweight and portable outfield boundary fence for playing a miniaturized form of baseball on a much smaller field than a regulation baseball field.

Another object of the invention is to provide an outfield boundary fence which is inexpensive, easy to set up and take down and which may be stored easily.

Another object of the invention is to provide a portable outfield boundary fence which may be struck by a player and wherein the fence is designed to simply bend or suffer minor damage without causing injury to the player.

A further object of the invention is to provide a portable outfield boundary fence which may be supported by stakes and tie lines wherein the stakes and tie lines are located entirely out-of-bounds.

Further objects and advantages of the invention will become apparent from the following description of the drawings and the preferred embodiment, wherein:

DETAILED DESCRIPTION OF THE DRAWINGS

Figure 1:
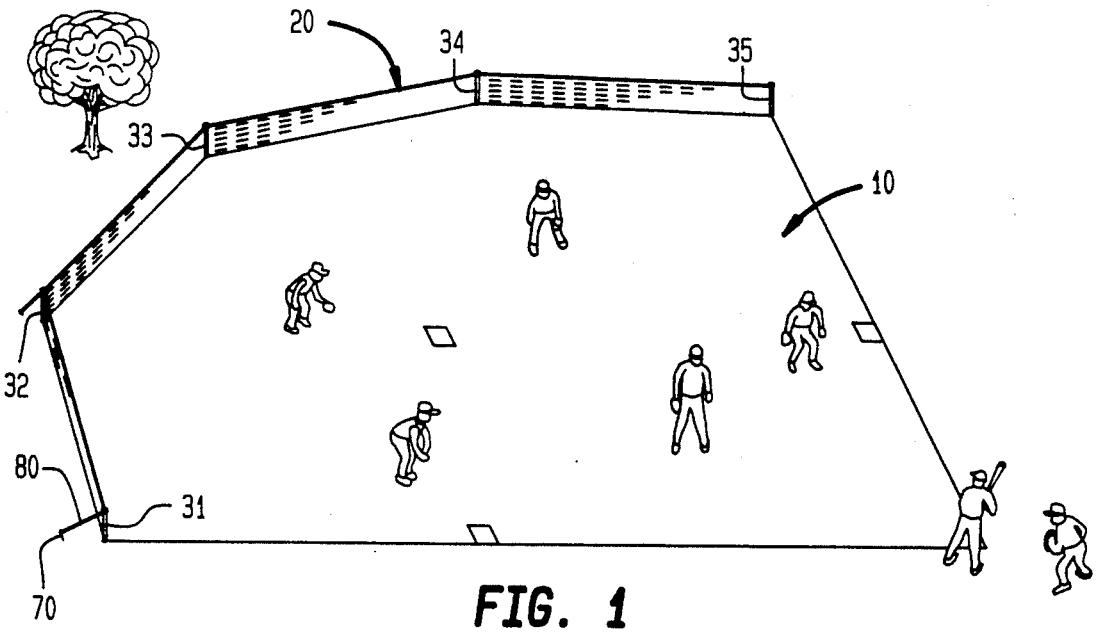
FIG. 1 represents a schematic representation of the portable outfield boundary fence of the present invention being used by a group of players.

As shown in FIG. 1, a portable outfield boundary fence shown generally as 20 is shown in its assembled position. The fence 20 forms the outfield boundaries for a miniaturized form of baseball, wherein a hollow, perforated plastic ball is used in conjunction with a hollow and lightweight plastic bat. Such hollow, perforated plastic balls and lightweight bats are commercially available and do not constitute a part of the present invention.

As shown in FIG. 1, a regulation baseball diamond is shown with home plate, three bases and the outfield boundary fence 20 which delineates home runs as well as foul balls. The size of the miniaturized ball diamond referred to generally as 10 may vary depending upon the age and strength of the players. For example, when players of approximately the age of 12 play the game, the bases may be spaced apart approximately 40 feet and the left field fence and right field fences may be located approximately 80 feet from home plate. The space requirement for this particular miniaturized form of baseball is much less than a regulation baseball diamond in which the bases are 90 feet apart and the left and right field foul lines may be 250 or 300 feet long.

Figure 2:
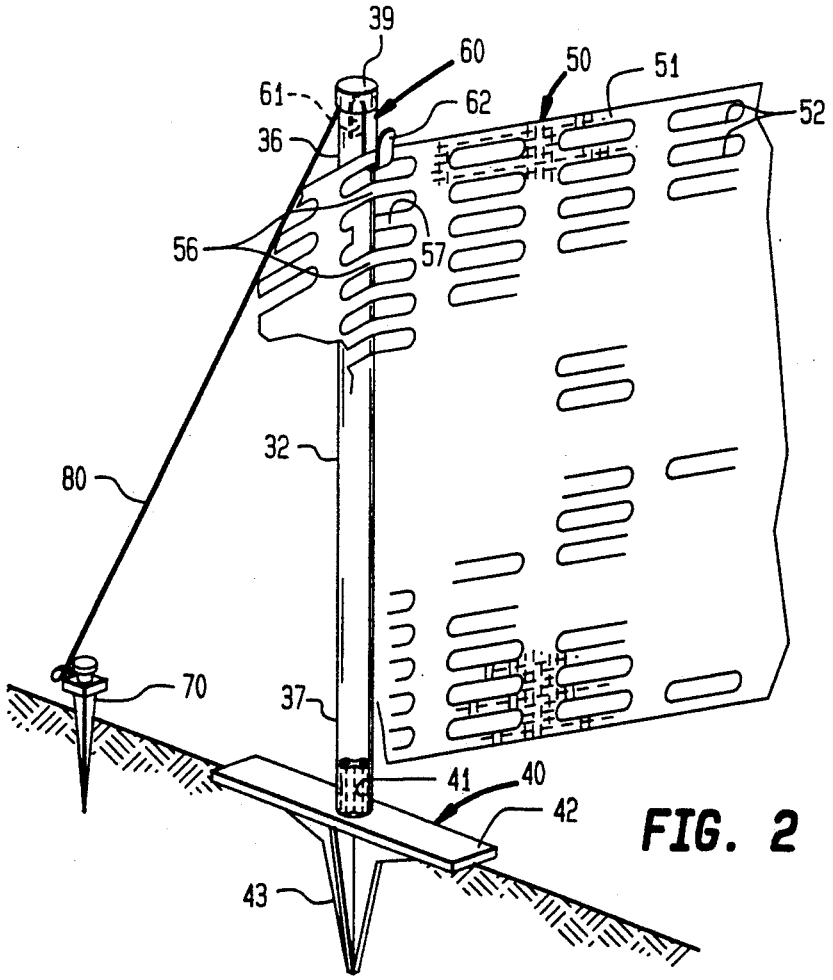
FIG. 2 is a perspective view, partially broken away, of a portion of the boundary fence shown in FIG. 1.

The portable fence 20 includes a plurality of hollow tubular posts 31, 32, 33, 34 and 35, post anchors such as 40, shown in FIG. 2, perforated netting 50 and connecting means 60 for attaching perforated netting 50 to posts such as post 32, shown in FIG. 2. An optional feature is the use of stakes 70 and ties 80, shown in FIG. 2.

Each of posts 31–35 is hollow and tubular and may be made of relatively inexpensive PVC pipe. As shown in FIG. 2, post 32 has a top 36 and a base 37. A cap 39 slides over the top of post 32.

Post anchor 40 has a vertical stem 41 shown in phantom which slidably and removably engages the base 37 of post 32. Anchor 40 also has a horizontal plate 42 which has a sufficiently large surface area for a user to press downwardly with a hand or foot in order to drive anchor 40 into the ground. Anchor 40 also has a tapered and pointed tip 43 extending downwardly from horizontal plate 42.

As a safety feature, the base 37 of post 32 is sufficiently thin and the supporting vertical stem 41 is sufficient short so that, when impacted by a player, the post either readily bends or breaks away at its base to avoid injury to a player. In the event that the base 37 of the post 32 is broken, it is an easy matter to simply replace post 32 with an extra post provided for that purpose.

As shown in FIG. 2, perforated netting 50 is provided which is adapted to extend between posts 31–35. The netting can be utilized in either one long piece of netting, which extends all the way from post 31 to post 35, or netting 50 may be utilized in sections in which a single piece of fabric will extend from post 31 to post 33 or from post 31 to post 32. The perforated netting 50 comprises woven plastic fabric 51 in which a plurality of horizontal elongated slots 52 have been formed to provide reduction of wind resistance. Elongated perforations 52 have a horizontal length greater than the diameter of posts 31–35, and are also used to connect the netting material to posts 31–35. As an optional feature, posts 31–35 may be threaded through elongated slots 52, as shown in FIG. 2, so that a portion 56 of the net is carried on the front of post 32 and a portion 57 of the net is carried on the rear portion of post 32.

Connecting means 60 are carried by each of said posts to removably attach netting 50 to the posts. Connecting means 60 comprises a generally S-shaped clip wherein the upper portion 6 extends into the top of hollow post 32 and a lower portion or tongue 62 extends through a slot 52 in netting 50 to attach netting 50 to post 32.

Figure 3:
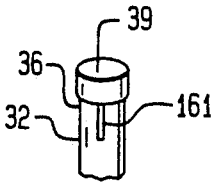
FIG. 3 is a schematic representation of an alternate embodiment of a portion of the invention.

FIG. 3 shows an alternate connecting means comprising a vertical slot 161 formed in the top 36 of post 32. Cap 39 is removed, the uppermost portion of net 50 is hung in slot 161 and cap 39 is pushed back onto post 32 to help retain net 50 in slot 161.

Another optional feature is the use of stakes 70 and ties 80. Stakes 70 and ties 80 may be positioned as shown generally in FIG. 1 to be located entirely in the out-of-bounds portion of the field so as not to interfere with play of the game.

A preferred embodiment of the invention, i.e. an outfield boundary fence for use in playing a miniaturized form of baseball, has now been described in detail. It is to be noted, however, that this description of this specific embodiment is merely illustrative of the principles underlying the inventive concept. The portable sport boundary fence may be used in any number of different configurations for any recreational boundary purpose. It is therefore contemplated that various modifications of the disclosed embodiment will, without departing from the spirit and scope of the invention, be apparent to persons skilled in the art.

I claim:

1. A portable fence used to establish sport boundaries, said fence comprising:

a plurality of hollow, tubular posts, each having a top and a base, a plurality of post anchors, each of said anchors having a vertical stem for slidably and removably engaging the base of one of said hollow posts, a horizontal plate supporting said vertical stem, said horizontal plate having sufficiently large surface area for a user to be able to press downwardly on said horizontal plate with a hand or foot, and a tapered, pointed tip extending downwardly from said horizontal plate, said posts being sufficiently thin at their bases, and said vertical stems supporting said posts being sufficiently short that, when impacted by a player, the post readily bends and/or breaks away at its base to avoid injury to said player, perforated netting adapted to extend between said posts, and connecting means carried by each of said posts to removably attach said netting to said posts.

2. The apparatus of claim 1 further comprising: ties connected to the tops of at least some of said posts, and tapered stakes adapted to be pushed into the ground of the out-of-bounds side of said fence and adapted to connect to said ties to stabilize said posts.

3. The apparatus of claim 1 wherein said netting has a plurality of horizontal elongated slots formed therein, the horizontal length of said slots being greater than the diameter of said posts.

4. The apparatus of claim 1 wherein said connecting means comprises an S-shaped clip having an upper portion which extends into the top of a post and a lower tongue portion which extends through an elongated slot in said netting.

5. The apparatus of claim 1 wherein said connecting means comprises a vertical slot formed in the top of said posts to receive a portion of said perforated netting.

* * * * *